US006397748B1

(12) United States Patent
Schmitt

(10) Patent No.: US 6,397,748 B1
(45) Date of Patent: Jun. 4, 2002

(54) VACUUM PRINTING PLATE MOUNTER AND REGISTRATION SYSTEM

(75) Inventor: Paul Schmitt, Albert Lea, MN (US)

(73) Assignee: Vacu-Pin Systems, LLC, Alberta Lea, MN (US)

( * ) Notice: Subject to any disclaimer, the term of this patent is extended or adjusted under 35 U.S.C. 154(b) by 0 days.

(21) Appl. No.: 09/617,672

(22) Filed: Jul. 17, 2000

(51) Int. Cl.[7] ..... B41F 27/00

(52) U.S. Cl. ..... 101/389.1; 101/486; 101/477; 101/383; 33/621

(58) Field of Search ..... 101/477, 415.1, 101/389.1, 382.1, 383, DIG. 36, 485, 486; 33/614, 616, 617, 621; 269/21, 35; 279/3; 248/362, 363

(56) References Cited

U.S. PATENT DOCUMENTS 2,123,549 A * 7/1938 Williams ..... 248/363
3,514,065 A * 5/1970 Litt et al. ..... 248/363
5,377,590 A * 1/1995 Bolza-Schunemann et al. ..... 101/389.1
5,427,363 A * 6/1995 Rink et al. ..... 269/21
5,479,858 A * 1/1996 Beisel et al. ..... 101/477
5,626,076 A 5/1997 Ireton ..... 101/401.1
5,715,751 A * 2/1998 Nobuta et al. ..... 101/415.1

OTHER PUBLICATIONS

Swing Arm Photopolmer Pin Register System: "Increased accuracy, increased production for photopolyer plate mounting." no date.

Swing Arm Photopolymer Pin Register System: The post–process punch that keeps photopolymer plate registration "on target." no date.

* cited by examiner

*Primary Examiner*—Leslie J. Evanisko
(74) *Attorney, Agent, or Firm*—Jacobson & Johnson

(57) ABSTRACT

A printer plate having an integral alignment target and a printing plate mounter having a vacuum cup with an alignment member thereon to permit visual alignment of the alignment target with the vacuum cup alignment member with the vacuum cup connectable to a vacuum source so that a vacuum can draw the printing plate alignment target and the alignment member on the vacuum cup from a state of state of misalignment, if any, into precise mechanical alignment for transfer to a printing cylinder while the vacuum cup supports the printing plate.

6 Claims, 6 Drawing Sheets

VACUUM PRINTING PLATE MOUNTER AND REGISTRATION SYSTEM

FIELD OF INVENTION

This invention relates generally to printing, and more specifically, to a vacuum printing plate mounter and registration device for mounting in register a flexographic printing plate onto a sticky back cylinder.

BACKGROUND OF THE INVENTION

One of the traditional way for mounting flexographic printing plates onto a sticky back cylinder is the use of a pair of cameras, each operatively connected to a split screen to display microdots on the printing plate. The printing plate is then manually manipulated to bring the microdots into a center screen to register the plate.

Another way for mounting flexographic printing plates onto a sticky back cylinder is by first having the plate targets aligned after which either a pneumatic punch or a precision drill is used to effect holes in the outer perimeter of the plate. The punched/drilled plates are then transferred to a pin-bar. The punched or drilled holes are then slid over pins that are affixed to the bar. The plate is then applied to its particular plate cylinder which has pre-applied sticky back material to hold the plate in place. This method take a great deal of time and money and occasionally results in the plates being deformed.

The present invention provides a vacuum printing plate mounter which uses a vacuum source to precisely align a target on printing plate with an annular member located in a vacuum cup after the vacuum cup has been visually aligned with the target on the printing plate. After mechanical alignment of the vacuum cup with the target, the vacuum cup supports and maintains the printing plate in position as the printing plate is transferred to the sticky cylinder.

DESCRIPTION OF THE PRIOR ART

U.S. Pat. No. 5,626,076 discloses a system for mounting flexible printing plates by physical register record plate and a method for physical register record plate.

SUMMARY OF THE INVENTION

Briefly, the present invention comprises a flexographic printing plate and flexographic printing plate mounter having a slide or support moveable from a down position to an up position. The slide slidably supports a vacuum cup which is connected to one end of a vacuum tube. The other end of the vacuum tube is connected to a foot operable vacuum source which is used to control the suction force of the vacuum cup to enable the vacuum cup to mechanically align with a target on a flexographic printing plate after the target and the flexographic printing plate have been visually aligned. Once the target is mechanically aligned, the vacuum cup supports the flexographic printing plate as the plate is moved from a down position to the up position where the flexographic printing plate can be the transferred to a sticky back cylinder.

DESCRIPTION OF THE PREFERRED EMBODIMENT

Figure 1:
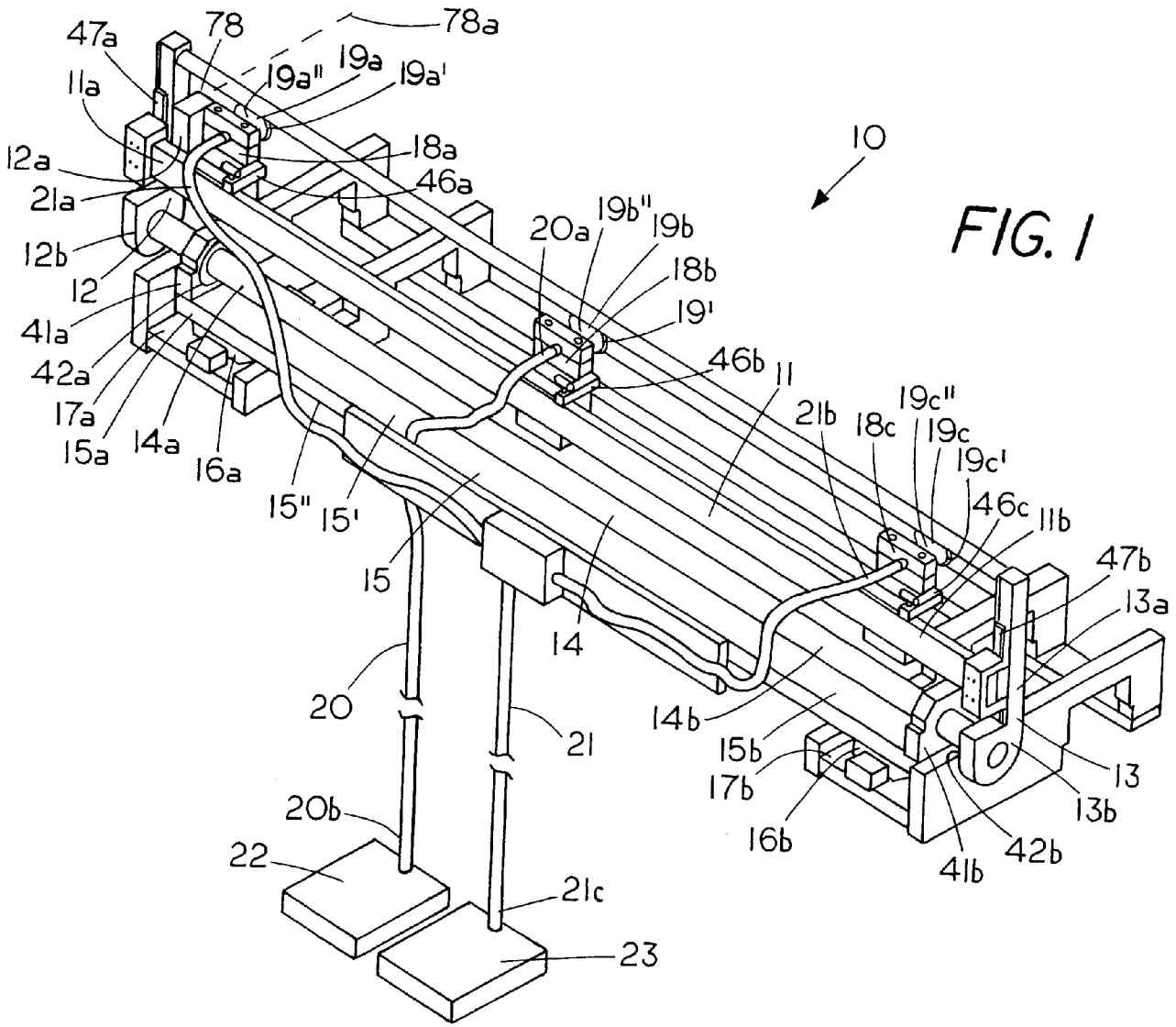
FIG. 1 shows a perspective view of a vacuum printing plate mounter.

Referring to FIG. 1, reference numeral 10 identifies a vacuum printing plate mounter of the present invention for mounting a flexographic printing plate on a sticky back cylinder.

Reference numeral 11 identifies a horizontal slide or support having a first end 11*a* and a second end 11*b*. One end of horizontal slide 11 is slidably connected to a first vertical alignment slide 47*a* and the opposite end of horizontal slide is slidably connected to a second vertical alignment slide 47*b* to allow for vertical positioning of horizontal slide 11 along arm 12 and arm 13.

Shaft 14 rotateable supports first arm 12 and second arm 13 with shaft 14 fixedly connected to first arm 12 at end 12*b* of first arm 12 and at end 13*b* of second arm 13 to enable first arm 12 and second arm 13 to move in unison. Encircling first end 14*a* of shaft 14 is a first bearing 42*a* and a first bearing block 41*a*. Similarly, encircling second end 14*b* of shaft 14 is a second bearing 42*b* and a second bearing block 41*b*. The bearings and bearing blocks allow shaft 14 to simultaneously move or rotate support arms 12 and 13 from a horizontal position (FIG. 7) to the vertical position shown in FIG. 1 and FIG. 8.

First vertical alignment slide 47*a* is carried by a first arm 12, having a first end 12*a* and a second end 12*b* which is connected to end 14*a* of rotatable shaft 14. Similarly second vertical slide 47*b* is carried by a second arm 13 having a first end 13*a* and a second end 13*b* which is connected to end 14*b* of rotatable shaft 14.

The first bearing block 41*a* and second bearing block 41*b* are supported by a base plate 15. Base plate 15 has a first end 15*a* and a second end 15*b*, a first side 15' and a second side 15" with the first bearing block 41*a* supported at first end 15*a* of base plate 15 and second bearing block 41*b* supported at second end 15*b* of base plate 15.

Connected to end 15*a* of base plate 15 is a first transverse slide 16*a* and connected to opposite end 15*b* is a second transverse slide 16*b*. The first transverse slide 16*a* is slidable with respect to a first mounting bracket 17*a* and similarly, second transverse slide 16*b* is slidable with respect to a second mounting bracket 17*b* to permit base plate 15 to be slidable positioned in a horizontal direction. Thus the plate mounter 10 provides for positioning in three different coordinate axis.

Slidable mounted on horizontal slide 11 is a first alignment guide 18*a*, a second alignment guide 18*b*, and a third alignment guide 18*c* which are positionable laterally along horizontal slide 11 for mounting and supporting a printing plate thereon as the printing plate is transferred to a sticky back cylinder.

Figure 3:
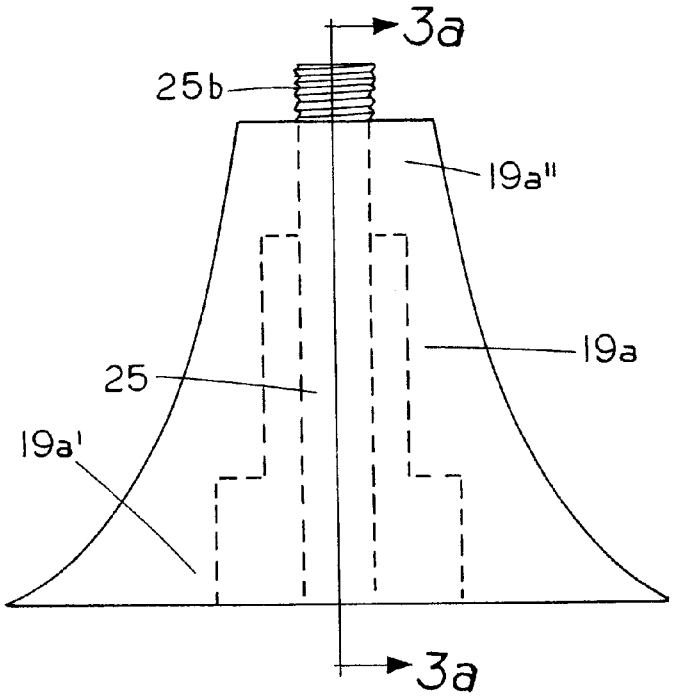
FIG. 3 shows a side view of a vacuum cup which has a bell shape configuration.
Figure 3A:
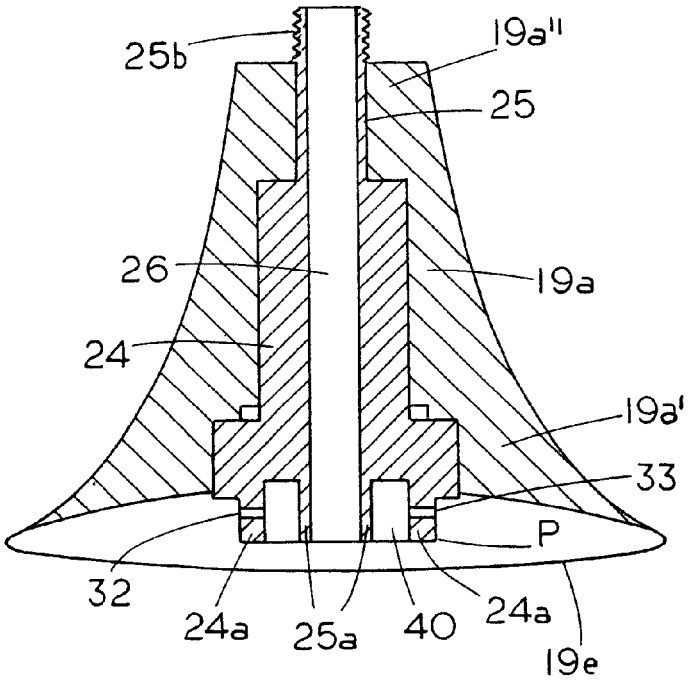
FIG. 3*a* is a cross-sectional view taken along the lines 3*a*—3*a* showing the first annular member and the second annular member inside the vacuum cup with one end of the first annular member protruding out of the vacuum cup and with both ends of the second annular body protruding out of the vacuum cup body.

The alignment guide 18*a*, which is shown in greater detail in FIG. 3. and FIG. 3*a* includes a vacuum cup 19*a* having a first end 19*a*' and a second end 19*a*". Also included on horizontal slide 11 are two identical alignment guides 18*b* and 18*c* with second alignment guide 18*b* having a vacuum cup 19*b* having a first end 19*b*' and a second end 19*b*" and third alignment guide 18*b* having a vacuum cup 19*c* having a first end 19*c*' and a second end 19*c*". Each of the alignment guides are slidably positionable along horizontal slide 11 and can be secured in position by a pressure clamp that engages slide 11. First alignment guide 18*a* is securable by a first clamp 46*a*, second alignment guide 18*b* is securable by a second clamp 46*b*, and third alignment guide 18*c* is securable by a third clamp 46*c*. Each of the alignment guides are independently positionable along horizontal slide 11 to enable an operator to precisely position the alignment guides with respect to a flexographic printing plate.

Figure 2:
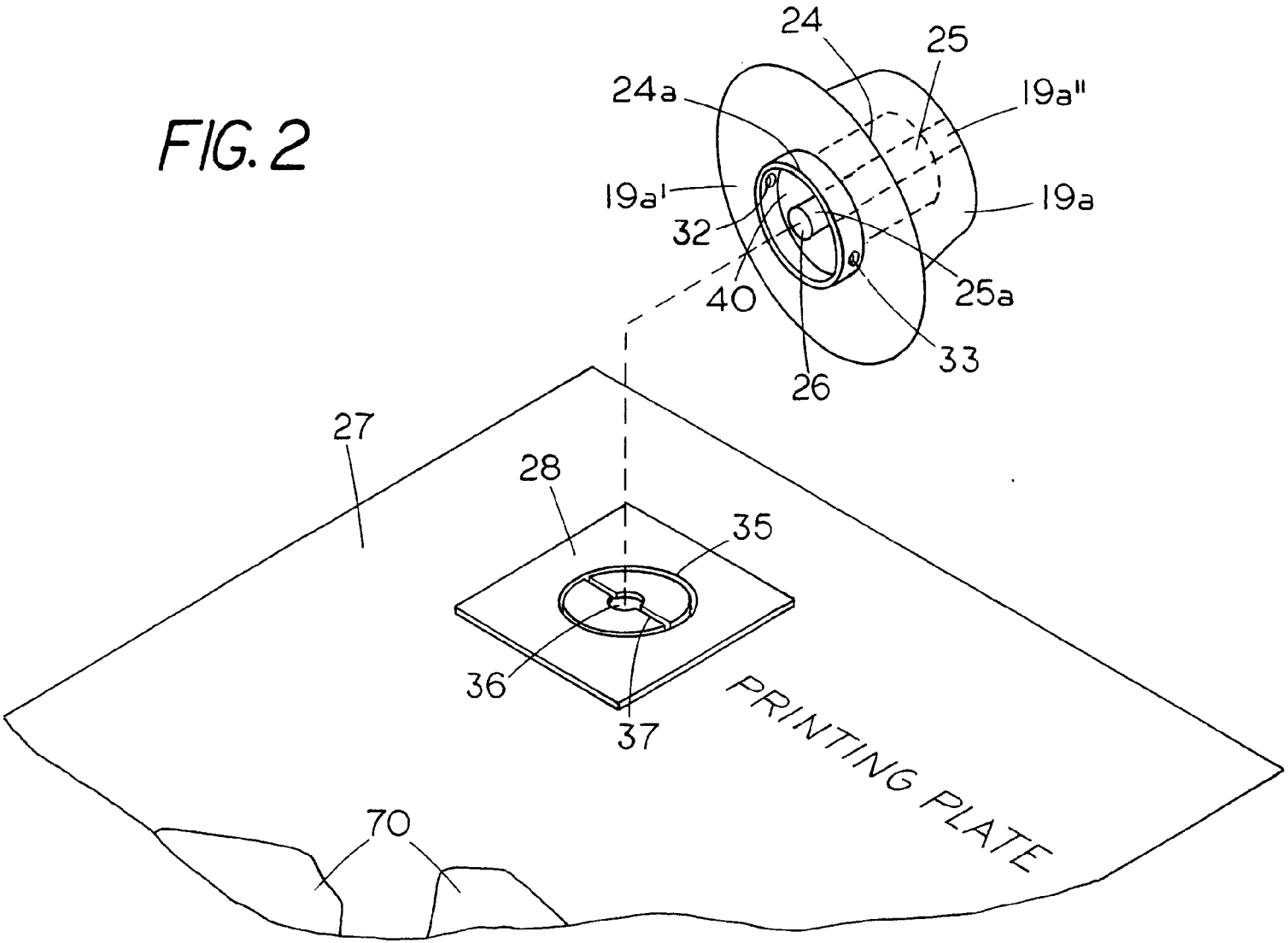
FIG. 2 shows a portion of a printing plate with a target and a vacuum cup.

FIG. 1 shows that each of the vacuum cups 19*a*, 19*b* and 19*c* connect to a vacuum source. A first end 20*a* of flexible vacuum tube 20 connects to vacuum cup 19*b* and a second end 20*b* of flexible vacuum tube 20 connected to a foot operated vacuum source 22. In addition, a second flexible vacuum tube 21 has one end 21*c* connected to a foot operated vacuum 23. The other end of vacuum tube 21 bifurcates with one bifurcated end 21*a* connected to end vacuum cup 19*a* and the other bifurcated end 21*b* connected to vacuum cup 19*c*. The e first foot operable vacuum source 22 and second foot operable vacuum source 23 independently control a vacuum suction to allow vacuum cups 19*a*, 19*b* and 19*c* to mechanically align with their alignment tar gets on the printing plate after the targets and the vacuum cups have been visually aligned. The purpose of having a separate vacuum source or separate control of a vacuum source one of the alignment cups is to allow a user to align only one of the vacuum cups with one of the targets and then en gage and hold the printing plate while the other targets are aligned with the other vacuum cups. FIG. 2 shows a portion of a flexographic printing plate 27 composed of resilient flexible photopolymer which is transparent, allowing for see through visual alignment.

In order to provide precise alignment of the vacuum cups with a reference mark 45 on the sticky back cylinder 30 a laser generator 78, which is mounted on slide 11 is positioned so that the laser beam projection 78*a* is in alignment with the vacuum cup aligning members. Consequently, by raising and lowering the slide one can position the laser beam 78*a* to be in precise alignment with the mark 45 on the sticky back cylinder 30 and thus have the aligning members in the vacuum cups as well as the reference channels in the flexographic plate 27 in precise alignment for transfer to the sticky back cylinder.

FIG. 2 shows a portion of a flexographic printing plate 27 composed of resilient flexible photopolymer which is transparent, allowing for see through visual alignment. Flexographic printing plate 27 is made from a photo polymer with the printing plate including raised or protruding printing areas 70 and an alignment target 28, target 28 which also protrudes from flexographic printing plate 27. Thus target 28 as well as printing areas 70 are integral with flexographic printing plate 27. Target 28 has an outer annular channel 35 recessed therein. Located concentrically within circular channel 35 is a circular recess 36. Running diametrically through circular channel 35 is a connecting channel 37 that connects central recess 36 and circular channel 35. The purpose of connection channel 37 is to allow a vacuum drawn at the central recess 36 to also be drawn at annular channel 35 and radially beyond to bring the end cup 19*a*' into engagement with the target 28.

For ease in viewing a vacuum cup 19*a* is positioned next to flexographic printing plate 27 Vacuum cup 19*a* has a first end 19*a*' and a second end 19*a*". Protruding from the first end 19*a*' of vacuum cup 19*a* is a first end 24*a* of outer annular member 24 composed of a rigid material. Annular member 24 comprises an aligning member for aligning the target 28 with the printing plate mounter. Outer annular member 24 has a first end 24*a* having a first opening 32 and a second opening 33 which are shown diametrically opposed to one another to allow for a vacuum to be drawn in the region outside of outer annular member 24 and beneath end 19*a*' by a vacuum source which is connected to annular member 25.

FIG. 2, 3 and 3*a* show that located within first annular member 24 is a second annular member 25 composed of a rigid material. Annular member 25 comprises a second aligning member for aligning target 28 with the printing plate mounter. Second annular member 25 has a first annular end 25*a*. The first annular end 25*a* of second annular member 25 is shown protruding from first end 19*a*' of vacuum cup 19*a*. Located within second annular member 25 is a vacuum passage 26 for vacuum suction to flow through. Located between the first end 24*a* of first annular member 24 and the first end 25*a* of second annular member 25 is an annular recess 40.

FIG. 3 is a side view of vacuum cup 19*a* shown in FIG. 2. A second end 25*b* of second annular member 25 is shown protruding from the second end 19*a*" of vacuum cup 19*a* which allows for second flexible tube 21 to connect to vacuum tube 19*a*.

FIG. 3*a* shows a cross-sectional view of FIG. 3 taken along lines 3*a*—3*a*. First annular member 24 is shown extending from within vacuum cup 19*a* and protruding out of first end 19*a*' of vacuum cup 19*a*. Second annular member 25 is shown running through vacuum cup 19*a* and extending from both the first end 19*a*' of vacuum cup 19*a* and a second end 19*a*" of vacuum cup 19*a*. Vacuum passage 26 is also shown extending from the first end 19*a*' of vacuum cup 19*a* to the second end 19*a*" of vacuum cup 19*a*. The end 24*a* of outer annular member 24 and annual member 25*a* are shown extending outward to a common plane "p" which is recessed from a plane extending through the circumferential edge 19*e* of vacuum cup 19*a*.

Figure 4:
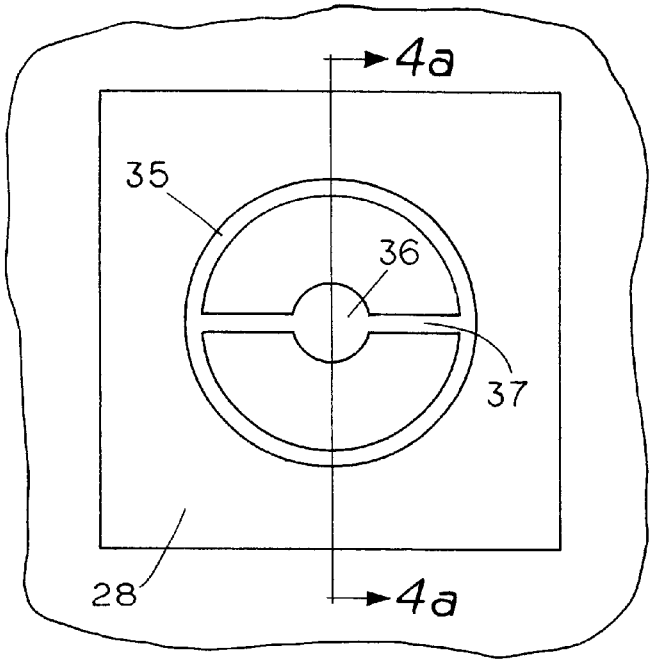
FIG. 4 shows a top view of the target located on a flexographic printing plate.

In order to appreciate the alignment target and how it coacts with a vacuum cup reference should be made to FIGS. 4, 4*a*, 5 and 5*a*. FIG. 4 Shows a top view of alignment target 28 in FIG. 2 with outer annular channel 35 positioned radially outward of central recess 36.

Figure 4A:
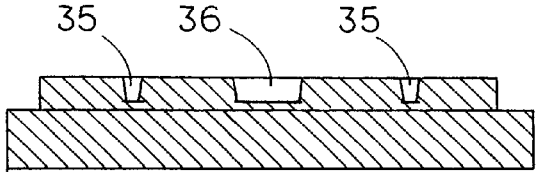
FIG. 4*a* shows a cross-sectional view taken along lines 2*a*—2*a* showing the depression of the channel and recess of the target on a flexographic printing plate.

FIG. 4*a* show a cross-sectional view of FIG. 4 taken along lines 4*a*—4*a* showing outer annular channel 35 and central recess 36 located therein. Channel 35 and recess 36 have been formed during the etching process when printing areas 70 were also etched in plate 27. Consequently, the position of target alignment guide can be precisely controlled in relation to the printing areas 70. As a result the target 28 forms a precise marker for positioning the printing plate 27. Although the target forms a precise marker for positioning the printing plate it still requires one to precisely pickup and transfer the print plate to a sticky back cylinder.

Figure 5:
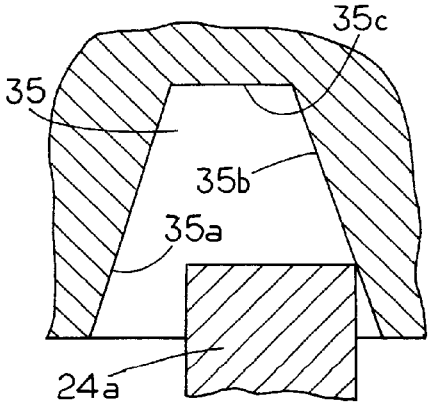
FIG. 5 shows a sectional view of a close-up of how a visual alignment might appear between an annular member and a depression on the target of a flexographic printing plate.

FIG. 5 is an enlarged view showing side 35*a* and side 35*b* having a generally inward slope that converges toward the bottom 35*c* of annular channel 35. As shown the converging sidewalls of annular channel 35 and circular recess 36 are obtained by the etching process used to create the recess in target 28. FIG. 5 illustrated how the target may be aligned during a visual alignment step.

Figure 5A:
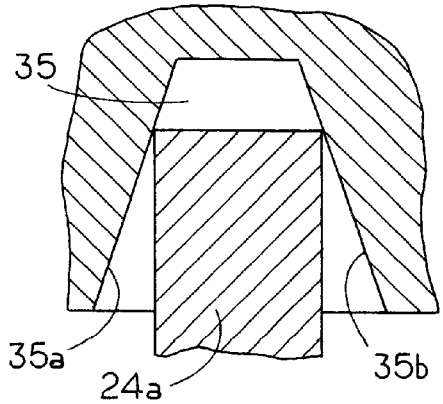
FIG. 5*a* shows a sectional view of a close-up of mechanical alignment between an annular member and a depression on the target of a flexographic printing plate.
Figure 6:
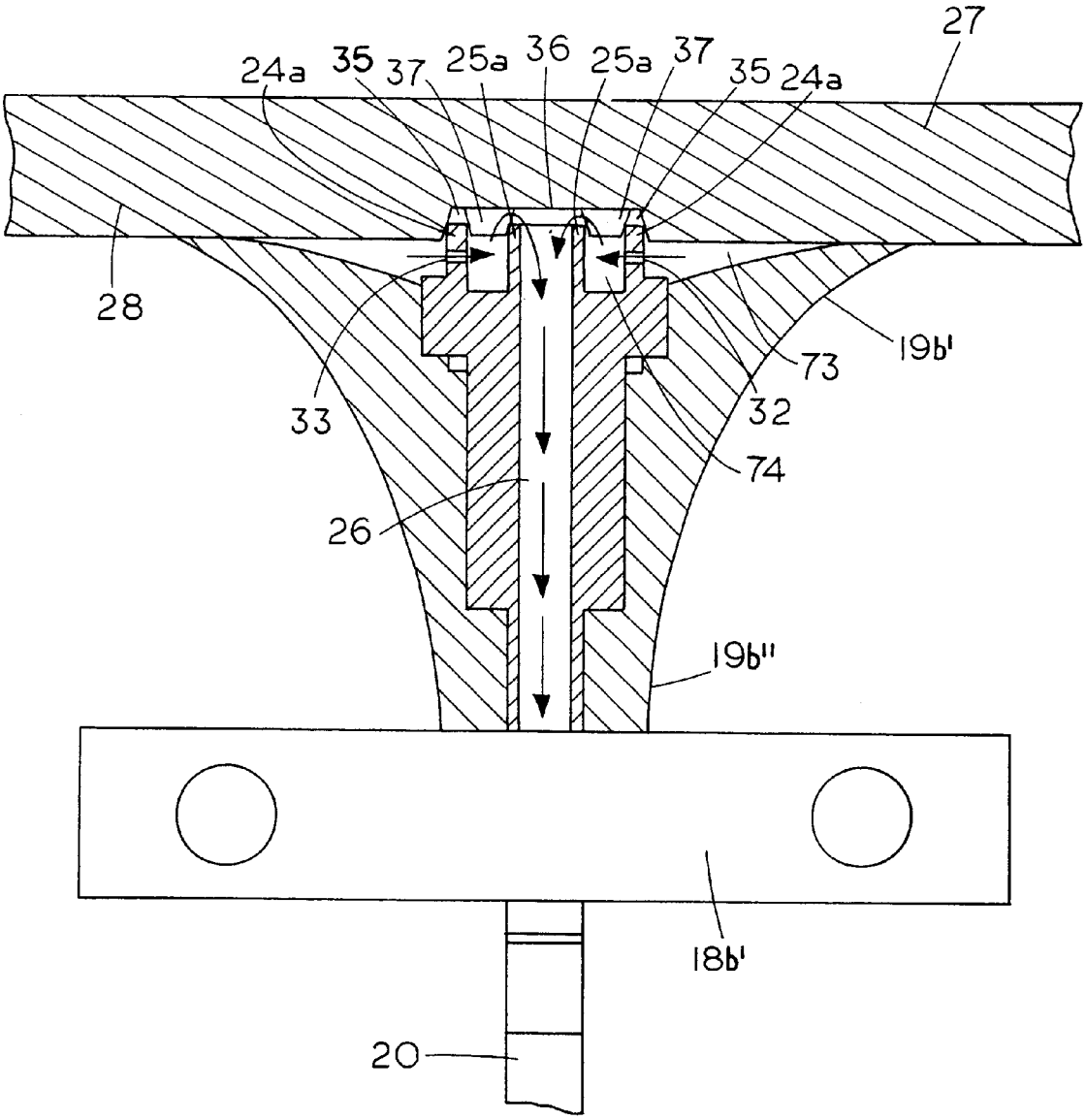
FIG. 6 illustrates an alignment of a target on a flexographic printing plate onto a vacuum cup by a mechanical alignment resulting from vacuum suction being applied.

FIG. 6 shows a cross-sectional view of the placing of printing plate 27 on vacuum cup 19*b*. The present process of mounting printing plate on vacuum cup 19*b* is a two step process. In the first step the target 28 is visually aligned and in the second step a vacuum is applied to the vacuum cup to mechanical align the target and the printing plate as well as to provide support for the printing plate to enable the printing plate to be transferred to a sticky back cylinder. As the printing plate comprises a transparent material the viewer can view the outer annular member 24*a* and inner annular member 25*a* from the underside of the print plate as illustrated by the arrow and schematic positioning of an eye. During the visual aligning step printing plate is slid laterally until the annular member 24*a* is in alignment with outer annular channel 35 and annular member 25*a* is in alignment with central recess 36. This completes the first step in the alignment process. FIG. 5 illustrates that during this visual alignment process there may be slight misalignment of annular member 24*a* with annular channel 35 as illustrated by annular member 24*a* engaging side wall 35*b* and not sidewall 35*a*. That is, a vacuum can draw the printing plate alignment target 28 and the alignment member 14 on the vacuum cup from a state of misalignment, if any, into precise mechanical alignment for transfer to a printing cylinder. Thus if during visual alignment step the annual member 24*a* is not fully seated within annular channel 35 the mechanically aligning step achieved through vacuum provides the necessary precise alignment. FIG. 5*a* illustrates the condition after precise mechanical alignment wherein annular member is fully seated within annular channel 35 and precisely aligned within annular channel 35.

To appreciate the step of precisely aligning the annular channel 35 with the annular member 24*a* reference should be made to FIG. 6. FIG. 6 shows plate 27 with target 28 positioned over annular members 24*a* and 25*a* With the target channels visually aligned with the annular members 24*a* and 25*a* the operator presses on foot vacuum 22 (FIG. 1) which produces a vacuum in passage 26 by drawing air through passage 26. The arrows indicate that air is drawn from region 73 between target 28 and vacuum cup 19*b* and flows through opening 33 and 32 and into annular region 74 where it flow along channel 37 and then outward along vacuum passage 26. Drawing a vacuum through passage 26 produces a two fold effect. First it provides an axial force that centers or aligns the two annular members 24*a* and 25*a* with the target 28. This step is illustrated in FIG. 5*a* which shows that annular member 24*a* has been drawn inward into alignment with annular channel 35. Thus the drawing of vacuum produces a precise mechanical alignment of the target with the annular members through the coaction of the vacuum forces and the sloping side walls 35*a* and 35*b* which force the annular member 24*a* into a centered position in channel 35. Second the vacuum provides a holding force to maintain the printing plate in position. That is the vacuum force generated by vacuum cup 19*b* provides a force to hold the printing plate in alignment position to permit handling of the printing plate in the plate mounter 10.

In the process of the invention, a first vacuum cup is visually aligned and then mechanically aligned by drawing a vacuum with foot vacuum 22. If more vacuum cups are used as for example vacuum cups 19*a* and 19*c* as shown in FIG. 1 the vacuum cups are positioned along slide 11 until both vacuum cups 19*a* and 19*c* are in visual alignment. Once in visual alignment the foot operated vacuum is activated to align the vacuum cups 19*a* and 19*c* with their respective targets. Once aligned the clamps can be secured to lock the vacuum cups in position.

With multiple vacuum cups a user can support larger printing plates as well as ensure that the printing plate is properly aligned. The preferred embodiment includes three vacuum cups but the actual number of vacuum cups required can be more or less than three. In general, the number of vacuum cups required is dependent on the size of the printing plates, larger printing plates requiring more vacuum cups while smaller printing plates requiring less vacuum cups.

With the printing plate now firmly held and precisely positioned on mounter 10 through the vacuum cups the final step of transfer of the printing plate to the sticky back cylinder can now be achieved.

Figure 7:
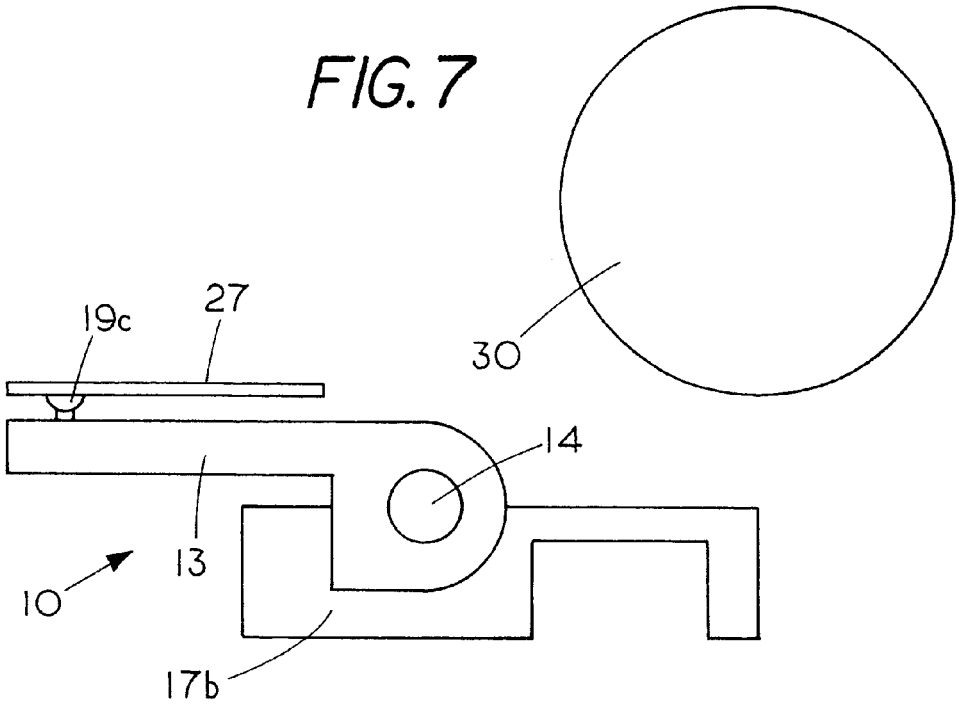
FIG. 7 is a side view showing a sticky back cylinder and a vacuum printing plate mounter with flexographic printing plate arms in a down position.

FIG. 7 shows a side view of sticky back cylinder 30 and vacuum printing plate mounter 10 in a down position, which is when second arm 13 is parallel with the second mounting bracket 17*b*. In the down position third vacuum cup 19*c* is shown supporting the printing plate 27, in addition vacuum cups 19*a* and 19*b* (FIG. 1) would also provide support of printing plate 27. In this condition the printing plate 27 is now ready for transfer to the sticky back cylinder 30.

Figure 8:
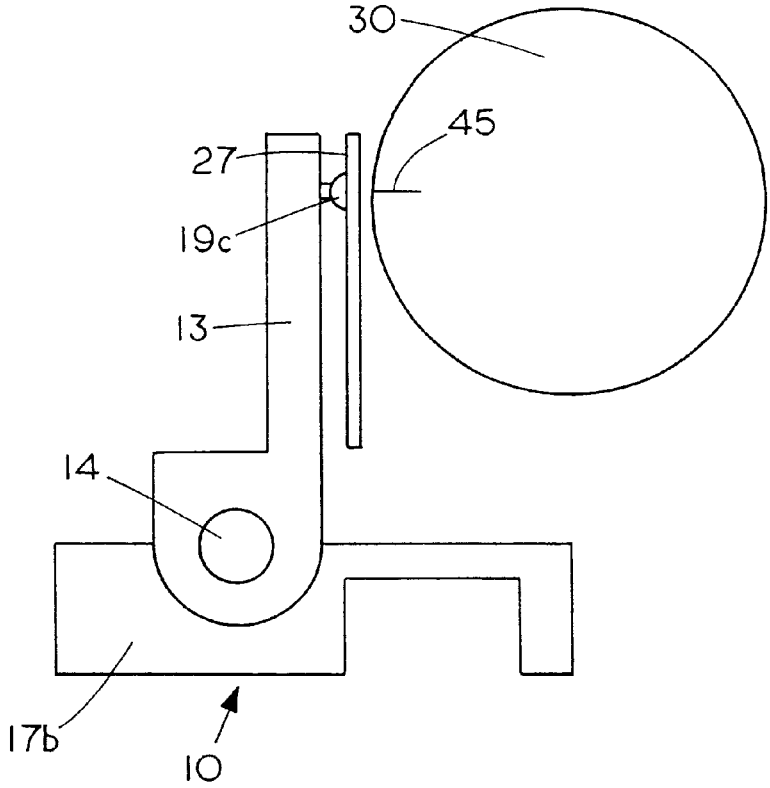
FIG. 8 is a side view showing a sticky back cylinder and a vacuum printing plate mounter with flexographic printing plate arms in an up position.

FIG. 8 shows a side view of printing cylinder 30 and vacuum printing plate mounter 10 moved from a down position to an up position. In the up position the printing plate 27 can be transferred to the sticky back cylinder 30. In the up position second arm 13 is perpendicular with second mounting bracket 17*b*. Note, sticky back cylinder 30, has a location mark 45, which is precisely angularly positioned so as to precisely receive flexographic printing plate 27. That is, printing plate 27 can be precisely positioned on sticky back cylinder 30 since the location of printing plate 27 with respect to mounter 10 is precisely known. The vacuum cups 19*c* and 19*a* (see FIG. 1) and 19*b* (see FIG. 1) supports flexographic printing plate 27 during the up position. It is in the up position that vacuum printing plate mounter 10 can transfer flexographic printing plate 27 to a sticky back cylinder 30 at the engaging point 45 of sticky back cylinder 30.

Once in the up position the printing plate 27 can be positioned vertically by first alignment slide 47*a* and the second alignment slide 47*b*, shown in FIG. 1, so as to precisely align flexographic printing plate 27 with the engaging point 45 on sticky back cylinder 30.

Flexographic printing plate 27 can be transferred to the engaging point 45 of sticky back cylinder 30 by the transverse slides 16*a* and 16*b* which allow the mounter arms 12 and 13 to move toward sticky back cylinder 30. Once the backside of flexographic printing plate 27 engages sticky back cylinder 30 the vacuum suction to vacuum cup 19*a*, 19*b* and 19*c* is cutoff thus releasing the support that vacuum cup 19*c* has on flexographic printing plate 27. Next the arms 12 and 13 are moved away from cylinder 30 and the sticky back cylinder is rotated to circumferentially secure the flexible plate in a printing position on cylinder 30.

I claim:

1. An apparatus for mounting a printing plate comprising:

a support, said support moveable from a first position to a second position;

a vacuum cup having a first end and a second end and a circumferential rim, said vacuum cup connected to said support, said vacuum cup second end having an aligning member, said aligning member comprises an outer annular member, said outer annular member having a passage therein to permit a vacuum to be drawn in a region radially outward of the outer annular member but radially inward of said circumferential rim of the vacuum cup to cause the vacuum cup to engage and support the printing plate thereon; and a vacuum source, said vacuum source connected to said first end of said vacuum cup to permit an operator to control a suction force on said vacuum cup so that when a target on the printing plate is visually aligned with said aligning member the suction force causes the vacuum cup to simultaneously mechanically align the target with the aligning member and to provide a holding support for the printing plate.

2. The apparatus of claim 1 wherein said support includes a slide for positionably supporting said vacuum cup.

3. The apparatus of claim 2 including a mounter having a clamp for securing said vacuum cup in fixed position on said slide.

4. The apparatus of claim 1 including a further aligning member coaxially positioned with respect to said outer annular member.

5. The apparatus of claim 4 wherein both of said aligning members are concentrically positioned within said vacuum cup.

6. An apparatus for mounting printing plates comprising:

a horizontal slide, said horizontal slide having a first end and a second end;

a first arm moveable from a first position to a second position and having a first end and a second end, said first arm connected to said first end of said horizontal slide;

a second arm moveable from the first position to the second position and having a first end and a second end, said second arm connected to said second end of said horizontal slide;

a rotatable shaft having a first end and a second end, said first end of said rotatable shaft connected to said second end of said first arm, said second end of said rotatable shaft connected to said second end of said second arm;

a first bearing and a first bearing block, said first bearing and said first bearing block encircling said first end of said rotatable shaft;

a second bearing and a second bearing block, said second bearing and said second bearing block encircling said second end of said rotatable shaft;

a base plate having a first end and a second end, said first end of said base plate connected to said first bearing block, said second end of said base plate connected to said second bearing block;

a first horizontal slide and a second horizontal slide, said first horizontal slide attached to said first end of said base plate, said second horizontal slide attached to said second end of said base plate;

a first mounting bracket and a second mounting bracket, said first mounting bracket attached to said first horizontal slide, said second mounting bracket attached to said second horizontal slide;

a first alignment guide, a second alignment guide, and a third alignment guide, said alignment guides attached to said horizontal slide between said first arm and said second arm;

a first vacuum cup, a second vacuum cup, and a third vacuum cup, said vacuum cups composed of a flexible resilient material, said first vacuum cup having a first end and a second end, said second vacuum cup having a first end and a second end, and said third vacuum cup having a first end and a second end, said first vacuum cup connected to said first alignment guide, said second vacuum cup attached to said second alignment guide, and said third vacuum cup attached to said third alignment guide;

a first vacuum tube composed of a flexible material, said first vacuum tube having a first end and a second end, said first end of said first vacuum tube connected to said second end of said second vacuum cup;

a second vacuum tube composed of a flexible material, said second vacuum tube having a first end, a second end, and a third end; said first end of said second vacuum tube connected to said second end of said first vacuum cup, said second end of said second vacuum tube connected to said second end of said third vacuum cup; and a first foot operable vacuum source and a second foot operable vacuum source, said first foot operable vacuum source connected to said second end of said first vacuum tube, said second foot operable vacuum source connected to said third end of said second vacuum tube, said first foot operable vacuum source and said second foot operable vacuum source control a vacuum suction of said vacuum cups so that when the printing plate is visually aligned with said vacuum cups at targets on said printing plate, in a down position of said arms, said suction is created by said first foot operable vacuum source and said second foot operable vacuum source allowing said vacuum cups to mechanically align with said targets and to support said printing plate, said printing plate adapted to be secured and mounted to a sticky cylinder by moving said arms from said down position to an up position.

* * * * *